US008587486B2

(12) United States Patent
Chiu et al.

(10) Patent No.: US 8,587,486 B2
(45) Date of Patent: Nov. 19, 2013

(54) MULTI-BAND ANTENNA

(75) Inventors: Chun-Ming Chiu, Tu-Cheng (TW); Po-Kang Ku, Tu-Cheng (TW); Wen-Fong Su, Tu-Cheng (TW); Hsien-Sheng Tseng, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 584 days.

(21) Appl. No.: 12/857,769

(22) Filed: Aug. 17, 2010

(65) Prior Publication Data

US 2011/0037680 A1 Feb. 17, 2011

(30) Foreign Application Priority Data

Aug. 17, 2009 (TW) ..... 98127535

(51) Int. Cl.
*H01Q 1/24* (2006.01)
*H01Q 1/48* (2006.01)

(52) U.S. Cl.
USPC ..... 343/702; 343/846; 343/848

(58) Field of Classification Search
USPC ..... 343/702, 846, 848, 700 MS
See application file for complete search history.

(56) References Cited

U.S. PATENT DOCUMENTS

| | | | | |
|---|---|---|---|---|
| 6,836,252 | B2 | 12/2004 | Tai et al. | |
| 7,050,010 | B2 * | 5/2006 | Wang et al. | 343/702 |
| 7,639,192 | B2 * | 12/2009 | Tsai et al. | 343/702 |
| 8,144,062 | B2 | 3/2012 | Ke et al. | |
| 2010/0053002 | A1 * | 3/2010 | Wojack et al. | 343/702 |
| 2010/0238072 | A1 * | 9/2010 | Ayatollahi et al. | 343/700 MS |

FOREIGN PATENT DOCUMENTS

| | | |
|---|---|---|
| CN | 2554814 | 6/2003 |
| CN | 101369683 | 8/2007 |
| CN | 101106211 | 1/2008 |
| CN | 101447600 | 6/2009 |
| TW | I240450 | 9/2005 |

* cited by examiner

*Primary Examiner* — Michael C Wimer
*Assistant Examiner* — Hasan Islam
(74) *Attorney, Agent, or Firm* — Wei Te Chung; Ming Chieh Chang

(57) ABSTRACT

A multi-band antenna (1) includes a grounding element (10) extending along a horizontal direction and including a side edge (101) with a connecting point (102) and a grounding point (103) distanced from the connecting point by a length, a first radiating element (11) disposed above and parallel to the grounding element (10), a second radiating element (12) apart from the first radiating element and extending upwardly from the side edge of the grounding portion, a connecting element (13) located between the first radiating element and the grounding element, a feeding point (134) disposed on the connecting element (13), and a feeding line (14) including an inner conductor (141) connected to the feeding point and an outer conductor (142) connected to the grounding point. The first radiating element operates in a first frequency band. The second radiating element defines a L-shaped configuration in a side view and operates in a second frequency band. The connecting element (13) includes a first end linked to an end of said first radiating element and a second end connecting to said connecting point of the grounding element. Said first radiating element extends from said first end of the connecting element along a direction away from the second radiating element, and forms a slot (15) together with said second radiating element and said connecting element.

20 Claims, 5 Drawing Sheets

MULTI-BAND ANTENNA

BACKGROUND OF THE INVENTION

1. Field of the Invention

The present invention relates generally to a multi-band antenna, and more particularly to a multi-band antenna used in an electric device.

2. Description of the Prior Art

In recent years, developments of portable wireless communication devices are speeded up. Considering the competitiveness, an antenna built in the device must have small size to save space and increase convenience.

A planar inverted-F antenna is always used inside an electric device. The inverted-F antenna usually comprises a first radiating element, a second radiating element extending from said first radiating element along a direction away from the first radiating element, a connecting element with an end connecting to the connection of the first and second radiating element, a grounding element connecting to the other end of the connecting element and a feed line linking to a feeder point on the connecting element. The current goes from the feeding point through the first radiating portion to operate in a first frequency band, and through the second radiating portion to operate in a second frequency band. TW Patent No. 1240450, which was issued to Cheng on May 1, 2005, discloses an antenna as above.

However, if the antenna works on a low frequency band, the length of the radiating element could be too long to adapt for present electronic device.

Hence, in this art, an improved antenna to overcome the above-mentioned disadvantages of the prior art should be provided.

BRIEF SUMMARY OF THE INVENTION

A primary object, therefore, of the present invention is to provide a multi-band antenna with a small size.

In order to implement the above object, the multi-band antenna comprises a grounding element extending along a horizontal direction and comprising a side edge with a connecting point and a grounding point distanced from the connecting point by a length, a first radiating element disposed above and parallel to the grounding element, a second radiating element apart from the first radiating element and extending upwardly from the side edge of the grounding portion, a connecting element located between the first radiating element and the grounding element, a feeding point disposed on the connecting element, and a feeding line comprising an inner conductor connected to the feeding point and an outer conductor connected to the grounding point. The first radiating element operates in a first frequency band. The second radiating element defines a L-shaped configuration in a side view and operates in a second frequency band. The connecting element comprises a first end linked to an end of said first radiating element and a second end connecting to said connecting point of the grounding element. Said first radiating element extends from said first end of the connecting element along a direction away from the second radiating element, and forms a slot together with said second radiating element and said connecting element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
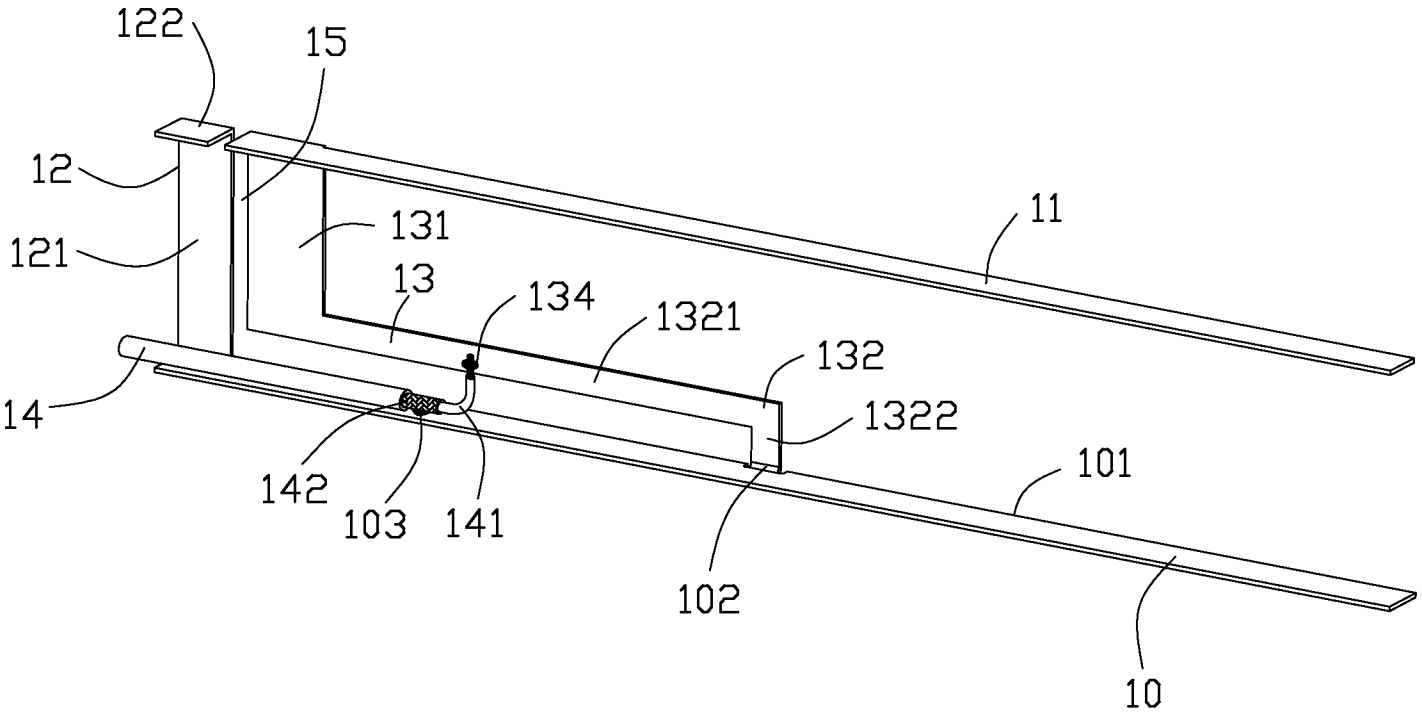
FIG. 1 is a perspective view of a multi-band antenna in accordance with a first embodiment of the present invention.
Figure 2:
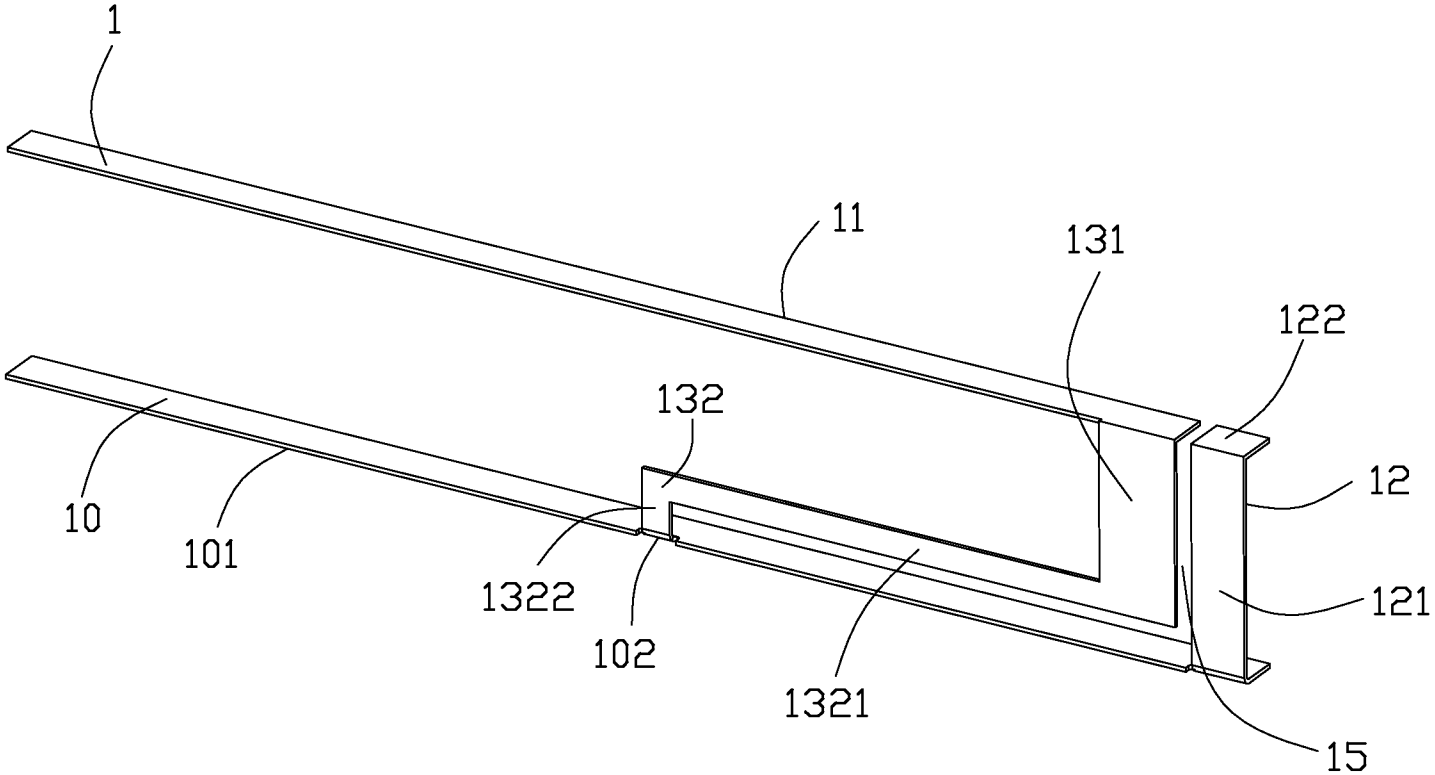
FIG. 2 is similar to FIG. 1, but viewed from another aspect.

Reference to FIGS. 1 to 2, a multi-band antenna 1 in accordance with a first embodiment of the present invention comprises a grounding element 10 extending longitudinally along a horizontal direction, a first radiating element 11 parallel to the grounding element, a second radiating element 12 connecting to the grounding element 10 and apart from the first radiating element 11, a connecting element 13 located between the grounding element 10 and the first radiating element 11, and a feeding line 14 linked to the connecting element 13.

The grounding element 10 is of rectangular configuration and comprises a side edge 101 with a connecting point 102 around the mid portion thereof The connecting element 13 extends upwardly from the connecting point 102 of the side edge 101 along a vertical direction. The first radiating element 11 is of rectangular configuration and extends from a top end of the connecting element 13 along a direction away from the second radiating element 12. The first radiating element 11 is rectangular and located above the grounding element 10. The second radiating element 12 is of L-shaped configuration in a side view and comprises a rectangular first segment 121 extending upwardly from the grounding element 10 along a vertical direction and a rectangular second segment 122 extending from the first segment 121 and parallel to the grounding element 10. The second segment 122 is disposed on the same plane with the first radiating element 11.

The connecting element 13 is roughly of N-shaped configuration and located on the same plane with the first segment 121 of the second radiating element 12. The connecting element 13 comprises a first arm 131 which is close to the second radiating element 12 and extending from an end of the first radiating element 11 along a direction perpendicular to the first radiating element 11, and an L-shaped second arm 132 connecting the first arm 131 to the grounding element 10 on the connecting point 102. The first arm 131 is the widest of all parts of the connecting element 13. The second arm 132 comprises a first portion 1321 extending from a low end of the first arm 131 along a horizontal direction away from the first segment 121, and a second portion 1322 connecting to the grounding element 10. The first portion 1321 is perpendicular to the second portion 1322. The first arm 131 of the connecting element 13 is parallel to the first segment 121 of the second radiating element 12 and the second portion 1322 of the L-shaped second arm 132.

A feeding point 134 is disposed on the first portion 1321 of the second arm 132. The feeding line 14 comprises an inner conductor 141 connected to the feeding point 134 to provide current for the multi-band antenna 1 and an outer conductor 142 connected to the grounding point 103 on the grounding element 10. The first radiating element 11, the second radiating element 12 and the first arm 131 of the connecting element 13 together form an L-shaped slot 15 to adjust the impedance of the multi-band antenna 1.

Figure 3:
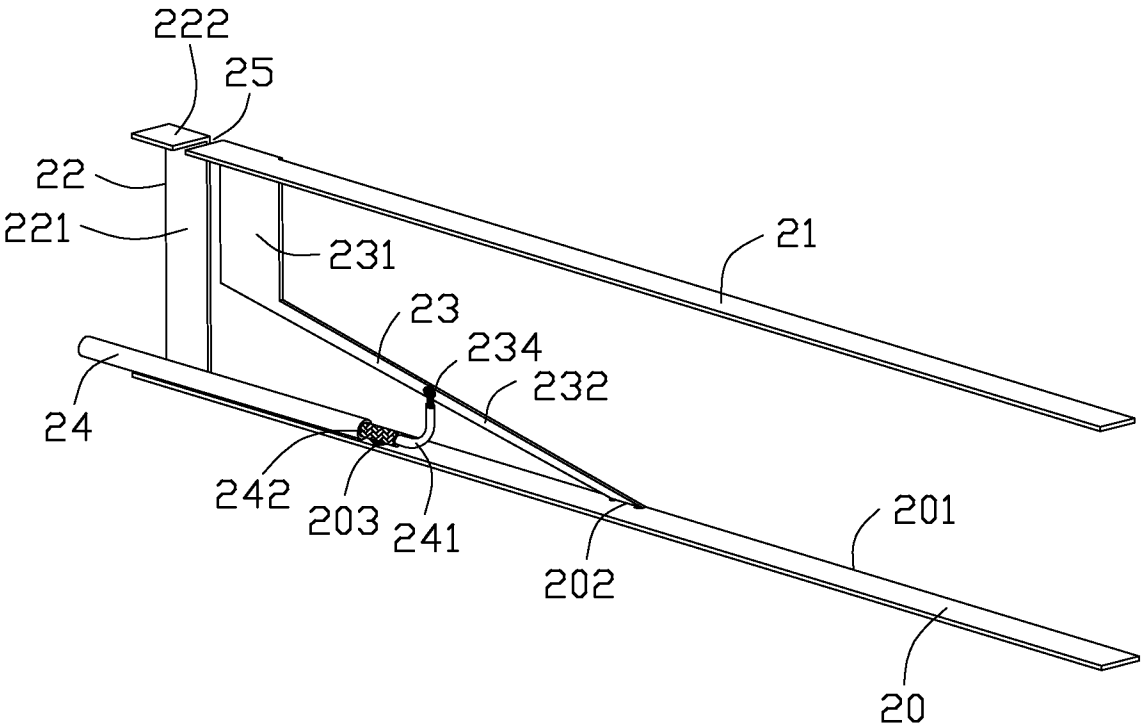
FIG. 3 is a perspective view of a multi-band antenna in accordance with a second embodiment of the present invention.

Reference to FIG. 3, a multi-band antenna 2 in accordance with a second embodiment of the present invention comprises a first radiating element 21, a second radiating element 22 including a first segment 221 and a second segment 222, a grounding element 20 with a side edge 201 and a feeding line 24, all of which above are similar to the corresponding components of the multi-band antenna 1 in the first embodiment. However, the multi-band antenna 2 further comprises a connecting element 23 different from the connecting element 13 in the first embodiment.

Figure 4:
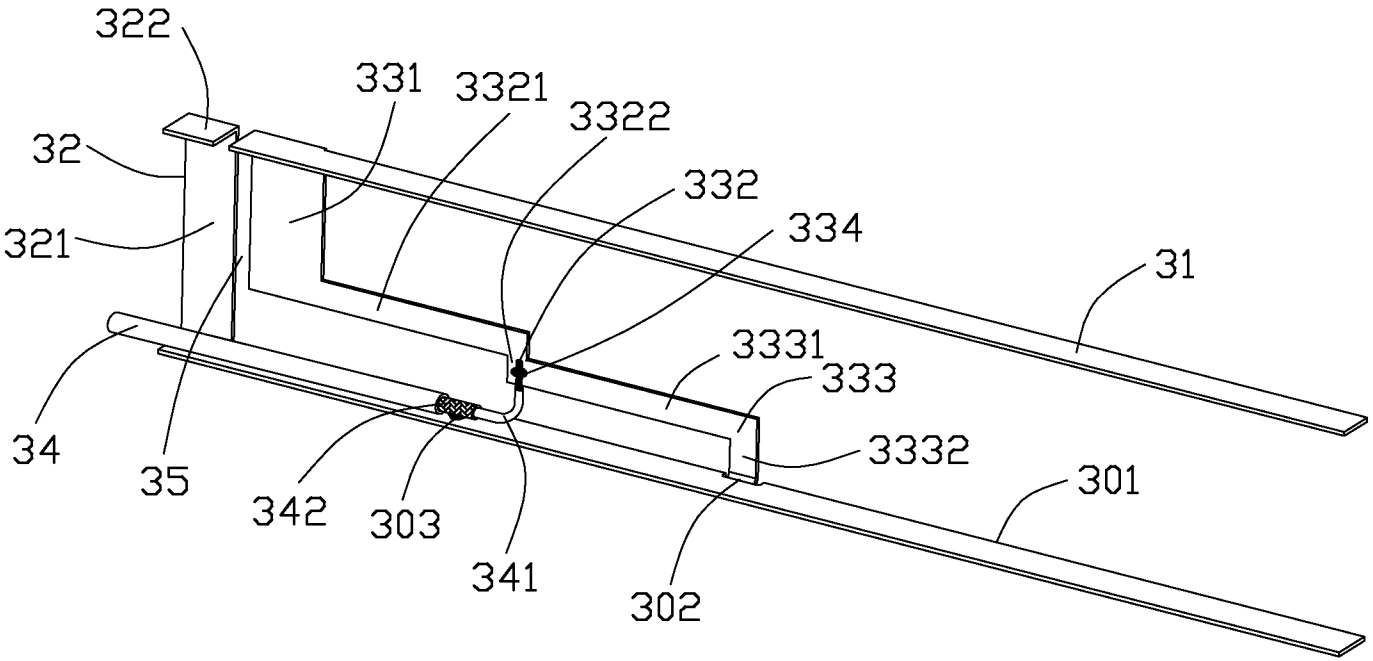
FIG. 4 is a perspective view of a multi-band antenna in accordance with a third embodiment of the present invention.

The connecting element 23 located between the first radiating element 21 and the grounding element 20 is disposed on the same plane with the first segment 221 of the second radiating element 22. The connecting element 23 includes a first arm 231 extending from an end of the first radiating element 21 along a direction perpendicular to the first radiating element 21 and adjacent to the first segment 221 of the second radiating element 12, and a second arm 232 extending from a low side of the first arm 231 to a connecting point 202 disposed on the side edge 201 of the grounding element 20 along a slantwise direction away from the second radiating element 22. The first arm 231 is the widest of all parts of the connecting element 23. A feeding point 234 is disposed on the second arm 232 of the connecting element 23. The feeding line 24 comprises an inner conductor 241 linked to the feeding point 234 and an outer conductor connected to a grounding point 203 disposed on the grounding element 20. And the first radiating element 21, the second radiating element 22, the first arm 231 of the connecting element 23 together form an L-shaped slot 25 to adjust the impedance of the multi-band antenna 2 by changing the size thereof Reference to FIG. 4, a multi-band antenna 3 in accordance with a third embodiment of the present invention comprises a first radiating element 31, a second radiating element 32 including a first segment 321 and a second segment 322, a grounding element 30 with a side edge 301 and a feeding line 34, all of which above are similar to the corresponding components of the multi-band antenna 1 in the first embodiment. However, the multi-band antenna 3 further comprises a connecting element 33 different from the connecting element 13 in the first embodiment.

The connecting element 33 between the first radiating element 31 and the grounding element 30 is disposed on the same plane with the first segment 321 of the second radiating element 32. The connecting element 33 includes a first arm 331 extending from an end of the first radiating element 31 along a direction perpendicular to the first radiating element 31 and adjacent to the second radiating element 32, and a second arm 332 composed of a first L-shaped body 332 and a second L-shaped body 333. The first L-shaped body 332 comprises a first part 3321 extending from the first arm 331 along a horizontal direction away from the first segment 321 of the second radiating element 32 and a second part 3322 perpendicular to the first part 3321. The second L-shaped body 333 includes a first portion 3331 extending from the second part 3322 along the same direction of the first part 3321 and a second portion 3332 linked to the grounding element 30 on a connecting point 302 on the side edge 301. The first arm 331 is the widest of all parts of the connecting element 33. A feeding point 334 is disposed on the second part 3322 of the first L-shaped body 332. The feeding line 34 comprises an inner conductor 341 linked to the feeding point 334, and an outer conductor 342 connecting to a grounding point 303 on the grounding element 30. And the first radiating element 31, the second radiating element 32, the first arm 331 of the connecting element 33 together form an L-shaped slot 35 to adjust the impedance of the multi-band antenna 3.

Figure 5:
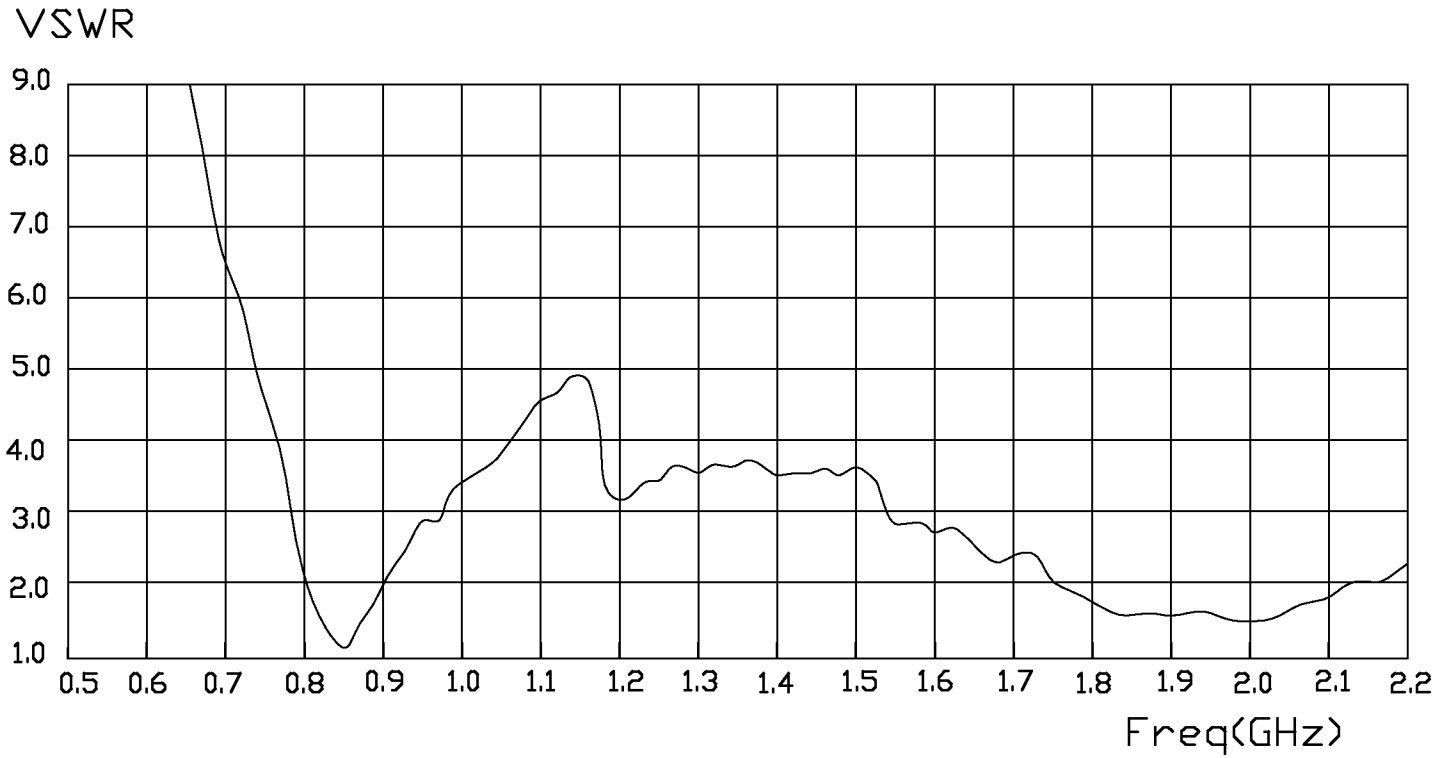
FIG. 5 is a test chart recording for the multi-band antenna of FIG. 1, showing Voltage Standing Wave Ratio (VSWR).

In all of above embodiments, the multi-band antenna 1,2,3 may be made by stamping or cutting a metal plate, or be printed or etched on a microwave substrate. And the grounding element 10,20,30 could be made from a metal plate while other elements of the multi-band antenna are printed or etched. The first radiating element 11,21,31 operates in a first lower frequency band, and the second radiating element 12,22,32 operates in a second higher frequency band, and both bands could be adjusted by changing the size of the slot 15,25,35. Reference to FIG. 5, it obviously that the multi-band antenna 1 works on a higher frequency band on 1.75-2.15 GHz and a lower frequency band on 0.8-0.9 GHz. The VSWR of the multi-band 2,3 is similar with the multi-band antenna 1, so it is not disclosed.

In other embodiments, the positions of the feeding point 134,234,334 could be changed, and the multi-band antenna 1,2,3 could work on other bands by adjusting the size of the first and second radiating element or the slot. And each component of the multi-band antenna 1,2,3 could have other shapes different from above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a grounding element extending along a horizontal direction, comprising a side edge with a connecting point and a grounding point distanced from the connecting point by a length;

a first radiating element disposed above and parallel to the grounding element, and operating in a first frequency band;

a second radiating element apart from the first radiating element, extending upwardly from the side edge of the grounding portion, defining an L-shaped configuration in a side view, and operating in a second frequency band;

a connecting element located between the first radiating element and the grounding element, comprising a first end linking to an end of said first radiating element and a second end connecting to said connecting point of the grounding element;

a feeding point disposed on the connecting element; and a feeding line comprising an inner conductor connected to the feeding point and an outer conductor connected to the grounding point; wherein said first radiating element extending from said first end of the connecting element along a direction away from the second radiating element, and forming a slot together with said second radiating element and said connecting element; wherein said grounding element and said first radiating element are arranged in a horizontal plane, said connecting element is arranged in a vertical plane perpendicular to the horizontal plane.

2. The multi-band antenna as claimed in claim 1, wherein said second radiating element comprises a rectangular first segment coplanar with said connecting element and connecting to the grounding element, and a rectangular second segment perpendicular to the first segment and coplanar with said first radiating element.

3. The multi-band antenna as claimed in claim 2, wherein said multi-band antenna is made by cutting or stamping a metal plate, or printing or etching a microwave substrate.

4. The multi-band antenna as claimed in claim 3, wherein said connecting element comprises a first arm connecting to said end of the first radiating element and adjacent to said second radiating element, and a second arm extending from the first arm to the grounding element away from the second radiating element, said second arm defining a feeding point.

5. The multi-band antenna as claimed in claim 4, wherein said second arm extends slantways from a low side of the first arm to the grounding element.

6. The multi-band antenna as claimed in claim 4, wherein said second arm is L-shaped and comprises a first portion extending from the first arm along a horizontal direction and a second portion extending from the first portion to the connecting point of the grounding element along a direction perpendicular to the first portion, said feeding point is disposed on the first portion of the second arm.

7. The multi-band antenna as claimed in claim 4, wherein said second arm comprises a first L-shaped body and a second L-shaped body, the first L-shaped body includes a first part extending from the first arm along a horizontal direction away from the second radiating element and a second part extending from the first part along a direction perpendicular to the first part, the second L-shaped body includes a first portion extending along the same direction with the first part of the first L-shaped body and a second portion extending from the first portion to the grounding element along a direction perpendicular to the first portion, and said feeding point is disposed on the second part of the first L-shaped body.

8. The multi-band antenna as claimed in claim 1, wherein said first frequency band is lower than the second frequency band, and both bands may be adjusted by changing the size of the slot which is of L-shaped configuration.

9. A multi-band antenna, comprising:

a grounding element extending longitudinally along a first direction;

a first radiating element apart from the grounding element and parallel to the grounding element, having a free end and an opposite end;

a connecting element connecting the opposite end of the first radiating element to the grounding element, comprising a first arm extending from said opposite end along a second direction perpendicular to the first radiating element and a second arm extending from the first arm to the grounding element away from said opposite end;

a feeding point disposed on the second arm of the connecting element;

a second radiating element extending from the grounding element and adjacent to said opposite end of the first radiating element, said second radiating element comprising a first segment coplanar with and parallel to the first arm of said connecting element and a second segment coplanar with said first radiating element and extending in a direction perpendicular to the first direction; wherein said first arm of the connecting element, said second radiating element and first radiating element together form a slot.

10. The multi-band antenna as claimed in claim 9, wherein said first radiating element is disposed above said grounding element, said second radiating element is of L-shaped configuration in a side view which further includes a second segment extending from said first segment along a direction perpendicular to the first segment and coplanar with said first radiating element.

11. The multi-band antenna as claimed in claim 10, wherein said first radiating element extends from the top side of said first arm of the connecting element along a direction away from the second radiating element.

12. The multi-band antenna as claimed in claim 11, wherein said first arm of the connecting element is the widest of all parts of the connecting element.

13. The multi-band antenna as claimed in claim 12, wherein said second arm is extending slantways from the low side of the first arm to the grounding element.

14. The multi-band antenna as claimed in claim 12, wherein said second arm comprises a L-shaped body which includes a first part perpendicular to said first arm and a second part connecting to said grounding element along a direction parallel to said second direction.

15. The multi-band antenna as claimed in claim 12, wherein said second arm comprises a first L-shaped body and a second L-shaped body, the first L-shaped body including a first part extending from said first arm along a direction parallel to the first direction and a second part perpendicular to the first part, the second L-shaped body including a first portion parallel to the first part and a second portion connecting to the grounding element along a direction parallel to the second direction.

16. The multi-band antenna as claimed in claim 15, wherein said feeding point is disposed on the second part of the first L-shaped body.

17. The multi-band antenna as claimed in claim 9, wherein said first radiating element operates in a lower frequency band, said second radiating element operates in a higher frequency band, and both of the bands may be adjusted by changing the size of the slot.

18. A multi-band antenna comprising:

a grounding element defining a first planar element horizontally extending along a longitudinal direction and lying at a lower level;

a first radiating element defining a second planar element horizontally extending along said longitudinal direction and lying at an upper level parallel to the grounding element;

a connecting element connected between said grounding element and said first radiating element and defining a first vertical plane perpendicular to both said first planar element and said second planar element, said connecting element including a vertical arm located on an upper portion thereof to connect to the first radiating element, and a lower arm located on a lower portion thereof to connect to the grounding element; and a second radiating element extending from the grounding element and defining a third planar element lying in a second vertical plane parallel to said first vertical plane and maintaining a constant distance along said longitudinal direction with the vertical arm of the connecting element, said second radiating element further defining a horizontal segment located at a top edge of said third planar element and in a parallel relation with the second planar element; wherein a feeding line includes an inner conductor connected to the lower arm of the connecting element and an outer conductor connected to the grounding element.

19. The multi-band antenna as claimed in claim 18, wherein the lower arm of the connecting element essentially extends with a distance along said longitudinal direction, and said outer conductor of the feeder line is connected to a middle region of said lower arm.

20. The multi-band antenna as claimed in claim 18, wherein said lower arm defines a two-step structure connected between the vertical arm of the connecting element and the grounding element.

* * * * *